US005647433A

United States Patent [19]

Sasaki

[11] Patent Number: 5,647,433

[45] Date of Patent: *Jul. 15, 1997

[54] HEAT EXCHANGER

[75] Inventor: Kenichi Sasaki, Isesaki, Japan

[73] Assignee: Sanden Corporation, Gunma, Japan

[ * ] Notice: The term of this patent shall not extend beyond the expiration date of Pat. No. 5,411,079.

[21] Appl. No.: 352,808

[22] Filed: Dec. 1, 1994

[30] Foreign Application Priority Data

Dec. 9, 1993 [JP] Japan ..... 5-341660

[51] Int. Cl.[6] ..... F28D 1/03

[52] U.S. Cl. ..... 165/148; 165/171

[58] Field of Search ..... 165/148, 171; 29/890.038

[56] References Cited

U.S. PATENT DOCUMENTS

| | | | |
|---|---|---|---|
| 2,926,003 | 2/1960 | Pulsifer | 165/170 X |
| 2,999,308 | 9/1961 | Pauls | 165/170 X |
| 3,286,328 | 11/1966 | Anderson . | |
| 3,368,261 | 2/1968 | Pauls | 29/890.042 |
| 5,067,562 | 11/1991 | Ishii . | |
| 5,099,576 | 3/1992 | Shinmura . | |
| 5,119,552 | 6/1992 | Sutou et al. . | |
| 5,411,079 | 5/1995 | Sasaki et al. . | |

FOREIGN PATENT DOCUMENTS

| | | | |
|---|---|---|---|
| 527341 | 5/1931 | Germany . | |
| 2145092 | 3/1973 | Germany | 165/171 |

*Primary Examiner*—Allen J. Flanigan
*Attorney, Agent, or Firm*—Baker & Botts, L.L.P.

[57] ABSTRACT

The present invention is directed to a heat exchanger which includes an upper and a lower tank and a plurality of heat exchange units extending between the upper and lower tanks. Each heat exchanger unit includes a plurality of plane portions and a plurality of pipe portions, each having a longitudinal axis. The pipe portions are spaced from one another at about equal intervals and place the upper and lower tanks in fluid communication. Adjacent pipe portions are connected by the plane portions. The heat exchanger is provided with a plurality of louvers formed in the plane portions along the longitudinal axis of the heat exchange unit. Each louver is formed by twisting a plane belt region which is defined between adjacent slits formed in the plane portions. A plane of each of the louvers is oriented to be substantially parallel to a plane which is perpendicular to the longitudinal axes of pipe portions. The heat exchange units are aligned, so that the plane portions are perpendicular to the flow direction of air which passes through the heat exchanger when the heat exchanger is installed.

12 Claims, 13 Drawing Sheets

HEAT EXCHANGER

BACKGROUND OF THE INVENTION

1. Field of the Invention

The present invention generally relates to a heat exchanger, such as a condenser or an evaporator, and more particularly, to heat exchangers including heat exchange units at which an exchange of heat occurs, that have openings and louvers.

2. Description of the Prior Art

A heat exchanger, such as an evaporator for use in an automotive air conditioning systems, as illustrated in FIG. 1, is well known in the art. For example, such heat exchangers are described in Japanese Patent Application Publication No. 6-117790, which is incorporated herein by reference.

Referring to FIG. 1, an evaporator 300 includes an upper tank 310 and a lower tank 320 which is vertically spaced from upper tank 310. Upper and lower tanks 310 and 320 are made of an aluminum alloy and are rectangular parallelepiped in shape. Moreover, each of tanks 310 and 320 has a length $l_t$ and a width $w_t$. Evaporator 300 further includes a plurality of hem exchange units 330 at which an exchange of heat occurs. Each of heat exchange units 330 also may be made of an aluminum alloy and includes a plurality of circular pipe portions 331 and a plurality of plane portions 332 which connect adjacent pipe portions 331. The intervals between pipe portions 331 are about equal.

Heat exchange units 330 are arranged in parallel along length $l_t$ of tanks 310 and 320 at about equal intervals and extend between upper and lower tanks 310 and 320. Upper and lower tanks 310 and 320 are placed in fluid communication through pipe portions 331. Pipe portions 331 of adjacent heat exchange units 330 are offset by one half of the length of the interval between pipe portions 331 of heat exchange unit 330. The length of heat exchange units 330 is designed to be substantially equal to the width $w_t$ of tanks 310 and 320, and heat exchange units 330 have longitudinal axes parallel to the width $w_t$ of tanks 310 and 320. Pipe portions 331 and plane portions 332 may be formed integrally from an aluminum alloy plate (not shown), for example, by extrusion. As shown in FIG. 4, the thickness $t_{pipe}$ of the walls of pipe portions 331 is designed to be greater than the thickness $t_{plane}$ of plane portions 332, so that pipe portions 331 are reinforced to sufficiently resist the internal pressure.

Referring to FIGS. 3–6, considered in view of FIG. 1, evaporator 300 is provided with a plurality of diagonally arranged first louvers 333 and a plurality of diagonally arranged second louvers 334 formed in plane portions 332 of heat exchange units 330. A method of forming first and second louvers 333 and 334 is described as follows. As shown in FIG. 2, a plurality of slant slits 335 are slit in each of plane portions 332 of heat exchange unit 330 generally along the longitudinal axis of heat exchange unit 330, for example, by press work. Slits 335 are spaced at about equal intervals $W_s$. Accordingly, a plurality of identical plane belt regions 336 are defined between adjacent slits 335. Plane belt regions 336 are alternately bulged in opposite directions from plane portion 332, for example, by press work. The above slitting and bulging steps may be accomplished, for example, by a single press work operation.

As a result of the bulging of plane belt regions 336, plane belt regions 336 are formed into first and second louvers 333 and 334, respectively, as illustrated in FIGS. 3–6. First and second louvers 333 and 334 alternately follow one another.

Each of first louvers 333 includes a flat roof section 333*a* and a pair of inclined leg sections 333*b* which connect roof section 333*a* to plane portion 332. Flat roof section 333*a* is parallel to plane portion 332 and is generally rhomboidal in shape. Thus, referring to FIG. 4, pairs of windows 333*c* having a generally trapezoidal configuration are formed at each upper and lower edge of first louvers 333, respectively.

Similarly, each of second louvers 334 includes a flat roof section 334*a* and a pair of inclined leg sections 334*b* which connect roof section 334*a* to plane portion 332. Flat roof section 334*a* is parallel to plane portion 332 and also is generally rhomboidal in shape. Thus, pairs of windows 334*c* having a generally trapezoidal configuration are formed at each upper and lower edge of second louvers 334, respectively. By providing first and second louvers 333 and 334, plane portions 332 function as fin members. Further, although only some of first and second louvers 333 and 334 located at upper and lower end portions of the end heat exchange unit 330' are depicted in FIG. 1, first and second louvers 333 and 334 are formed on the entire surface of each of plane portions 332 of each of heat exchange units 330.

Referring again to FIG. 1, the interior space of upper tank 310 is divided by a partition plate 340 into a first chamber section 310*a* and a second chamber section 310*b*. Upper tank 310 is provided with an inlet pipe 350 fixedly connected through an outside end surface of section 310*a* and an outlet pipe 360 fixedly connected through an outside end surface of section 310*b*.

Further, when evaporator 300 is installed, heat exchange units 330 are oriented, so that plane portions 332 are parallel to the flow direction "A" of air passing through evaporator 300, as illustrated in FIG. 1. Consequently, pipe portions 331 are perpendicular to the flow direction "A" of air passing through evaporator 300, as illustrated in FIGS. 3, 4, and 6.

During operation of the automotive air conditioning system, the refrigerant fluid is conducted into first chamber section 310*a* of the upper tank 310 from an element of the automotive air conditioning system, such as a condenser (not shown), via inlet pipe 350. The refrigerant fluid in the first chamber section 310*a* of upper tank 310 then flows downwardly through each of pipe portions 331 of a first group of heat exchange units 330. As the refrigerant fluid flows downwardly through each of pipe portions 331 of this first group of heat exchange units 330, the refrigerant exchanges heat with the air flowing across exterior surfaces of heat exchange units 330, so that heat from the air is absorbed through plane portions 332.

The refrigerant fluid flowing downward through pipe portions 331 of this first group of heat exchange units 330 flows into a first portion of an interior space of lower tank 320, which corresponds to section 310*a*. Thereafter, the refrigerant fluid in the first portion of the interior space of lower tank 320 flows towards a second portion of the interior space of lower tank 320, which corresponds to section 310*b*. The refrigerant then flows upward from the second portion of the interior space of lower tank 320 through each of pipe portions 331 of a second group of heat exchange units 330. As the refrigerant fluid flows upwardly through each of pipe portions 331 of the second group of heat exchange units 330, the refrigerant further exchanges heat with the air flowing across the exterior surfaces of heat exchange units 330, so that the heat from the air is further absorbed through plane portions 332.

The refrigerant fluid flowing upward through each of pipe portions 331 of the second group of heat exchange units 330 flows into second chamber section 310*b* of upper tank 310.

The refrigerant fluid in second chamber section 310b of upper tank 310 then is conducted to other elements of the automotive air conditioning system, such as a compressor (not shown), via outlet pipe 360.

However, in heat exchangers, such as those described above, performance of heat exchanger, e.g., evaporator 300, is generally insufficient. As shown in FIG. 6, air passing through evaporator 300 is cut by the upper edge of first louvers 333 (or second louvers 334). These edges have an effective length l defined by equation (1) as follows:

$$l=L_L \cdot \sin\theta \quad (1)$$

In equation (1), $L_L$ is the actual length of the upper edge of first louvers 333 (or second louvers 334), and theta θ is an angle created between the upper edge of first louvers 333 (or second louvers 334) and the flow direction "A" of air passing through heat exchanger 300. Further, the length $L_L$ of the upper edge of first louvers 333 (or second louvers 334) is approximately equal to the length $L_s$ of slits 335. Front edge effect is the increase in heat transmission from air to a louver by cutting the air flow by a front, i.e., leading, edge of the louver. In addition, for purposes of simplicity of explanation, only first louvers 333 are described hereinafter because the functioning of second louvers 334 is substantially the same as that of first louvers 333.

According to equation (1), when the degrees of angle theta θ increase in a range between 0° and +90°, the effective length l increases. Thus, with respect to first louvers 333, the following relationships are observed:

a. Angle Theta θ∝Effective Length l;

b. Effective Length l ∝Front Edge Effect;

c. Front Edge Effect ∝Heat Transfer Rate; and d. Heat Transfer Rate ∝Performance of Evaporator.

Accordingly, if the interval between adjacent pipe portions 331 of heat exchange unit 330 is fixed, the performance of evaporator 300 is directly proportional to angle theta θ. Thus, when the degrees of angle theta θ increase, the heat transfer rate, i.e., the heat transfer coefficient, of first louvers 333 increases, so that the performance of evaporator 300 also increases.

On the other hand, when the interval between adjacent pipe portions 331 of heat exchange unit 330 is fixed, when the degrees of angle theta θ increase, the length of first louvers 333 increases. Further, the length $L_L$ of first louvers 333 is also approximately equal to the length $L_s$ of slits 335. Thus, with respect to first louvers 333, the following relationships are observed:

a. Angle Theta θ∝Length $L_L$;

b. 1/(Length $L_L$)∝Fin Efficiency; and c. Fin Efficiency ∝ Performance of Evaporator.

Accordingly, if the interval between the adjacent pipe portions 331 of heat exchange unit 330 is fixed, the performance of evaporator 300 is inversely proportional to angle theta θ. Thus, when the degrees of angle theta θ increase, the fin efficiency of first louvers 333 decreases, so that the performance of evaporator 300 also decreases.

As described above, the heat transfer rate and the fin efficiency of first louvers 333 are functions of angle theta θ, but changes in angle theta θ have opposite effects on heat transfer rate and fin efficiency, which in turn cause opposite effects on performance of evaporator 300. Accordingly, in the heat exchangers discussed above, the performance is insufficient. Therefore, it is desirable to set angle theta θ at a certain value at which the contributions of the heat transfer rate and the fin efficiency of louvers 333 to the performance of evaporator 300 are balanced.

SUMMARY OF THE INVENTION

In accordance with the foregoing description, plane portions 332 of heat exchange units 330 function substantially as fin members. Thus, plane portions 332 may be thinned to the limits of the mechanical strength thereof. Therefore, a lightweight heat exchanger, e.g., an evaporator, may be obtained possessing advantages over prior art. Accordingly, it is an object of the present invention to provide a lightweight heat exchanger with increased performance.

An embodiment of a heat exchanger in accordance with the present invention includes a first tank and a second tank spaced vertically from the first tank. At least one connecting member extends between the first tank and the second tank. The at least one connecting member comprises a plurality of pipe portions, each having a longitudinal axis, which place the first tank and the second tank in fluid communication, and a plurality of plane portions one of which is fixedly disposed between each pair of adjacent pipe portions.

The heat exchanger further comprises a plurality of openings are formed at the plane portions along the longitudinal axis of the at least one connecting member. A plurality of louvers are formed at the openings, respectively, so that the louvers are parallel to a plane, which is perpendicular to the longitudinal axes of the pipe portions. The at least one connecting member is oriented, so that said plane portions are perpendicular to a flow direction of air which passes through the heat exchanger.

The invention further includes a method of manufacturing a heat exchanger. The manufactured heat exchanger includes a first tank and a second tank spaced vertically from the first tank, and at least one connecting member which extends between the first tank to the second tank. The at least one connecting member comprises a plurality of pipe portions, each having a longitudinal axis, which place the first tank and the second tank in fluid communication, and a plurality of plane portions. Each of these plane portions are fixedly disposed between a pair of adjacent pipe portions. The method comprises the steps of forming a plurality of slits in the plane portions along the longitudinal axis of the at least one connecting member, so that the slits are perpendicular to the longitudinal axes of the pipe portions, thereby defining a plurality of plane belt regions between the adjacent slits; and twisting each of the plane belt regions, so that the plane belt regions are parallel with a plane perpendicular to the longitudinal axes of the pipe portions.

In another embodiment, a heat exchanger comprises a first tank and a second tank spaced vertically from the first tank, and at least one connecting member which extends between the first tank and the second tank. The at least one connecting member comprises a plurality of pipe portions, each having a longitudinal axis, which place the first tank and the second tank in fluid communication; a plurality of plane portions, each of which extends between a pair of adjacent pipe portions; and a plurality of first arch portions and a plurality of second arch portions, the first and the second arch portions bulged in opposite directions and arranged in a plurality of rows. A plurality of openings are formed in the plane portions and extend along a longitudinal axis of the at least one connecting member, and a plurality of louvers are formed at the openings, respectively, so that the louvers are parallel to a plane, which is perpendicular to the longitudinal axes of the pipe portions. The at least one connecting member is oriented, so that the plane portions are perpendicular to a flow direction of air which passes through the heat exchanger.

In yet another embodiment, the invention is a method of manufacturing a heat exchanger, which includes a first tank and a second tank spaced vertically from the first tank, and at least one connecting member which extends between the first tank to the second tank. The at least one connecting member comprises a plurality of pipe portions, each having a longitudinal axis, which place the first tank and the second tank in fluid communication; a plurality of plane portions, each of which extends between a pair of adjacent pipe portions; and a plurality of first arch portions and a plurality of second arch portions, the first and the second arch portions bulged in opposite directions and arranged in a plurality of rows. The method comprises the steps of forming a plurality of slits in the plane portions along the longitudinal axis of the at least one connecting member, so that the slits are perpendicular to the longitudinal axes of the pipe portions, thereby defining a plurality of plane belt regions between the adjacent slits, and twisting each of the plane belt regions, so that the plane belt regions are parallel with a plane perpendicular to the longitudinal axes of the pipe portions.

Other objects, advantages, and features will be apparent when the detailed description and drawings are considered.

BRIEF DESCRIPTION OF THE DRAWINGS

For a more complete understanding of the present invention and the technical advantages thereof, reference is made to the following description taken in conjunction with accompanying drawings in which.

DETAILED DESCRIPTION OF THE PREFERRED EMBODIMENTS

Figure 1:
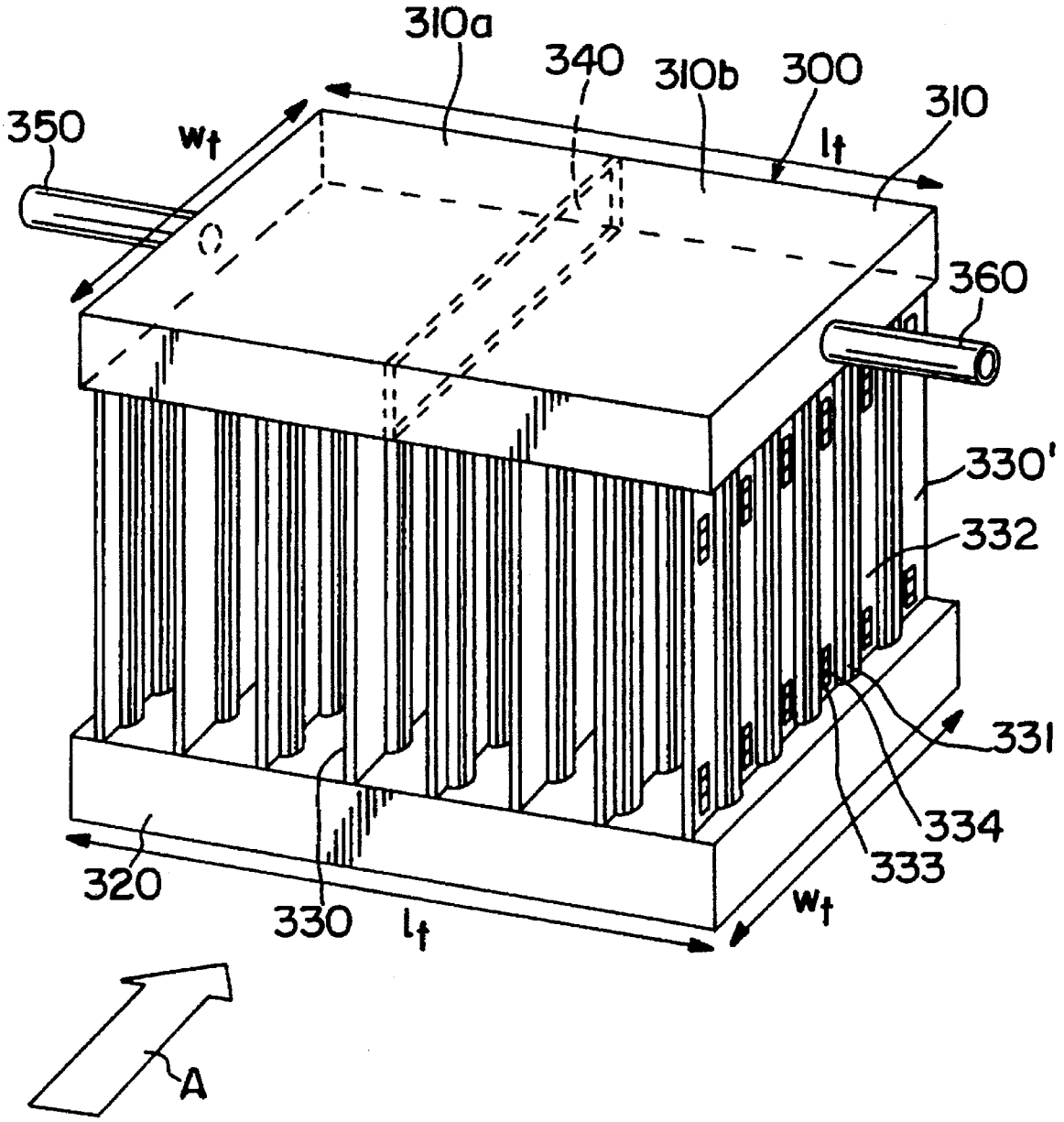
FIG. 1 PRIOR ART
FIG. 1 is a perspective view of an evaporator in accordance with the prior art.
Figure 2:
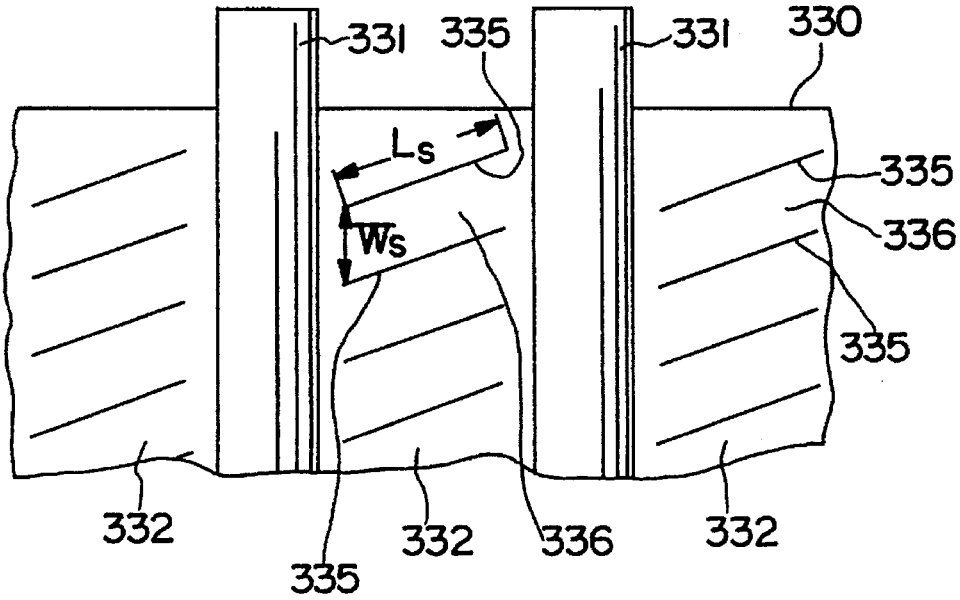
FIG.2 PRIOR ART
FIG. 2 is a view illustrating a portion of a forming process of louvers.
Figure 3:
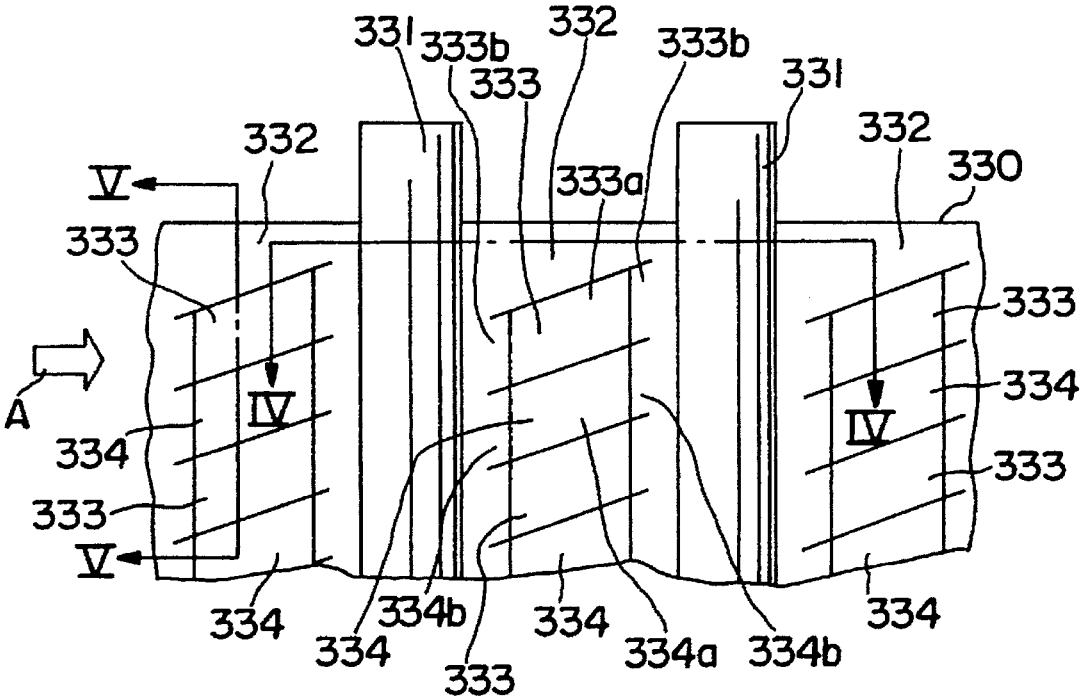
FIG.3 PRIOR ART
FIG. 3 is an enlarged front view of a portion of a heat exchange unit shown in FIG. 1.
Figure 4:
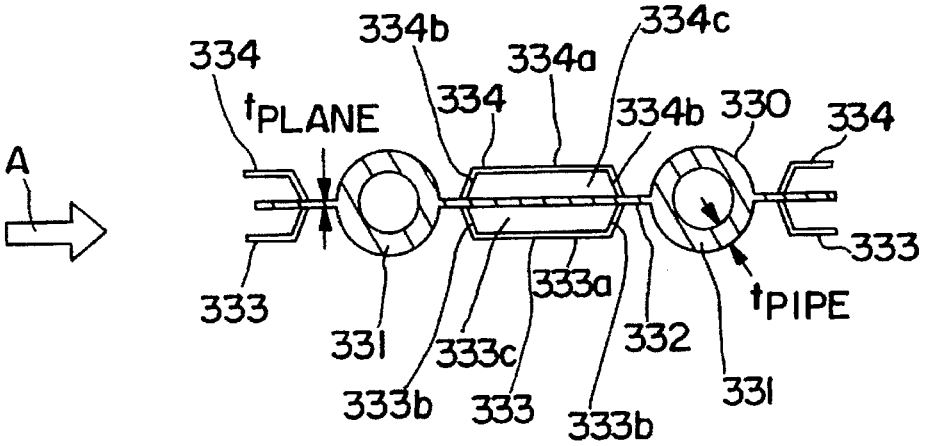
FIG. 4 PRIOR ART
FIG. 4 is a cross-sectional view taken along line IV—IV of FIG. 3.
Figure 5:
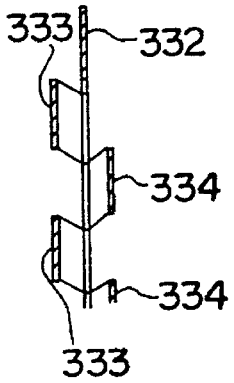
FIG. 5 PRIOR ART
FIG. 5 is a cross-sectional view taken along line V—V of FIG. 3.
Figure 6:
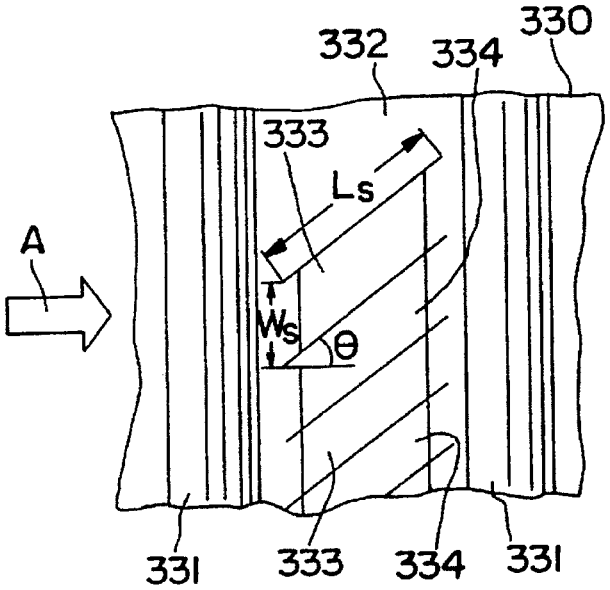
FIG. 6 PRIOR ART
FIG. 6 is an enlarged front view similar to FIG. 3 illustrating the functioning of the louvers of the prior art.
Figure 7:
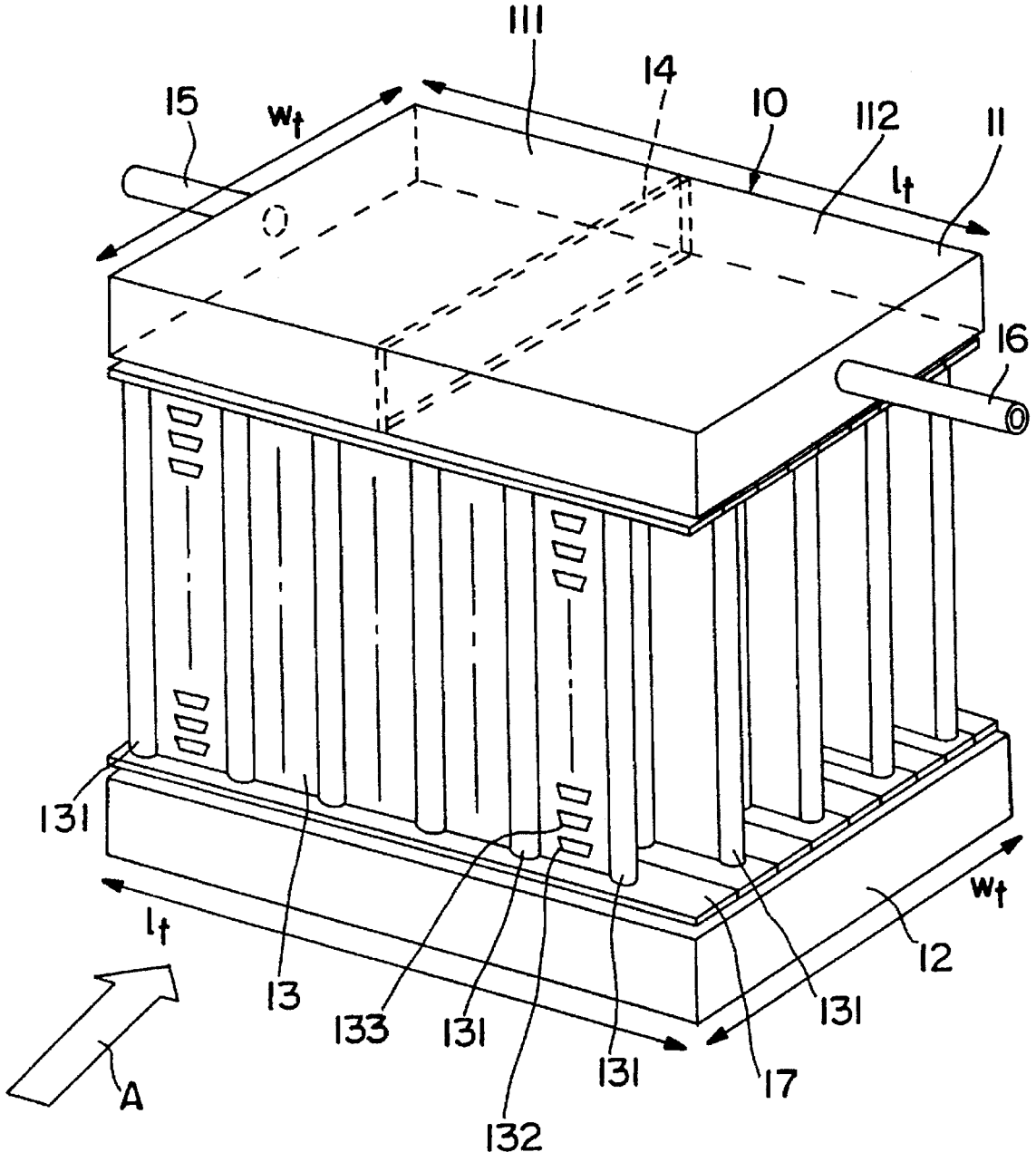
FIG. 7 is a perspective view of an evaporator in accordance with a first embodiment of the present invention.

A heat exchanger in accordance with a first embodiment of the present invention is illustrated in FIG. 7. In FIG. 7, evaporator 10 includes an upper tank 11 and a lower tank 12 which is spaced vertically from the upper tank 11. Upper and lower tanks 11 and 12 may be made of an aluminum alloy and are rectangular parallelepiped in shape. Evaporator 10 further includes a plurality of heat exchange units 13 at which an exchange of heat occurs. Each of heat exchange units 13 also may be made of an aluminum alloy and includes a plurality of circular pipe portions 131 which are spaced from one another at about equal intervals and a plurality of plane portions 132 which extend between adjacent pipe portions 131.

Figure 12:
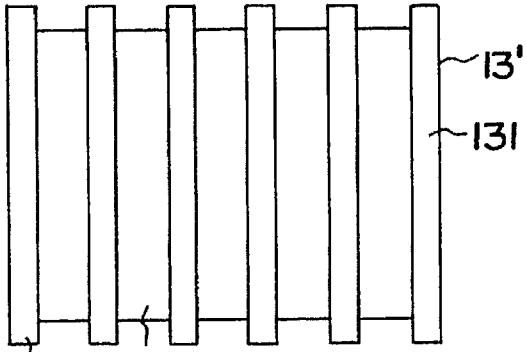
FIGS. 10–15 are views illustrating a step of a method for manufacturing the heat exchange unit shown in FIG. 7.
Figure 13:
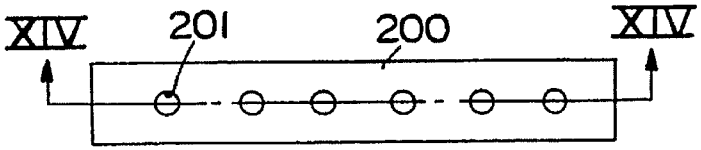
Figure 14:
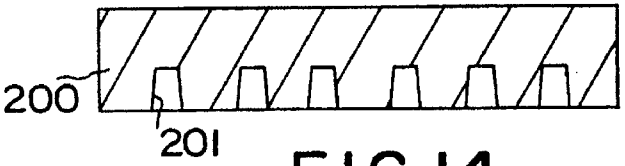
Figure 10:
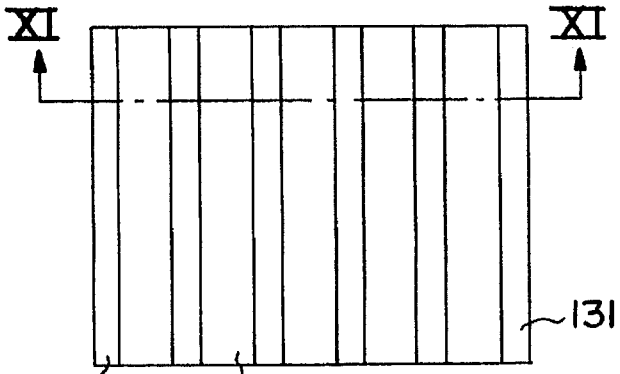
Figure 11:
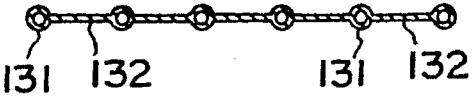

Referring to FIGS. 10–15, each heat exchange unit 13 may be formed by the following method. First, as illustrated in FIGS. 10 and 11, pipe portions 131 and plane portions 132 may be formed integrally as an aluminum alloy plate (not shown), for example, by extrusion. Then, an upper end section of each of plane portions 132 may be simultaneously cut out, for example, by press work. Similarly, a lower end section of each of plane portions 132 may be simultaneously cut out, for example, by press work. Thus, partially formed heat exchange unit 13', as illustrated in FIG. 12, may be prepared. Next, an upper end section of each of pipe portions 131 may be simultaneously tapered, for example, by drawing by means of a die 200, such as that illustrated in FIGS. 13 and 14. Die 200 may include a plurality of truncated cone-shaped hollow cavities 201 formed in one side surface thereof. A bottom end of each of truncated cone-shaped hollow cavities 201 may terminate at about the center of die 200. Each of truncated coneshaped hollow cavities 201 may be tapered toward the bottom end thereof. Such hollow cavities 201 are spaced from one another at about equal intervals, so that they correspond to pipe portions 131 of heat exchange units 13. The upper end sections of each of pipe portions 131 may be simultaneously tapered, for example, by drawing. Similarly, the lower end sections of each of pipe portions 13 1 may be simultaneously tapered, for example, by drawing. Thus, heat exchange unit 13, such as that illustrated in FIG. 15, may be obtained.

Figure 8:
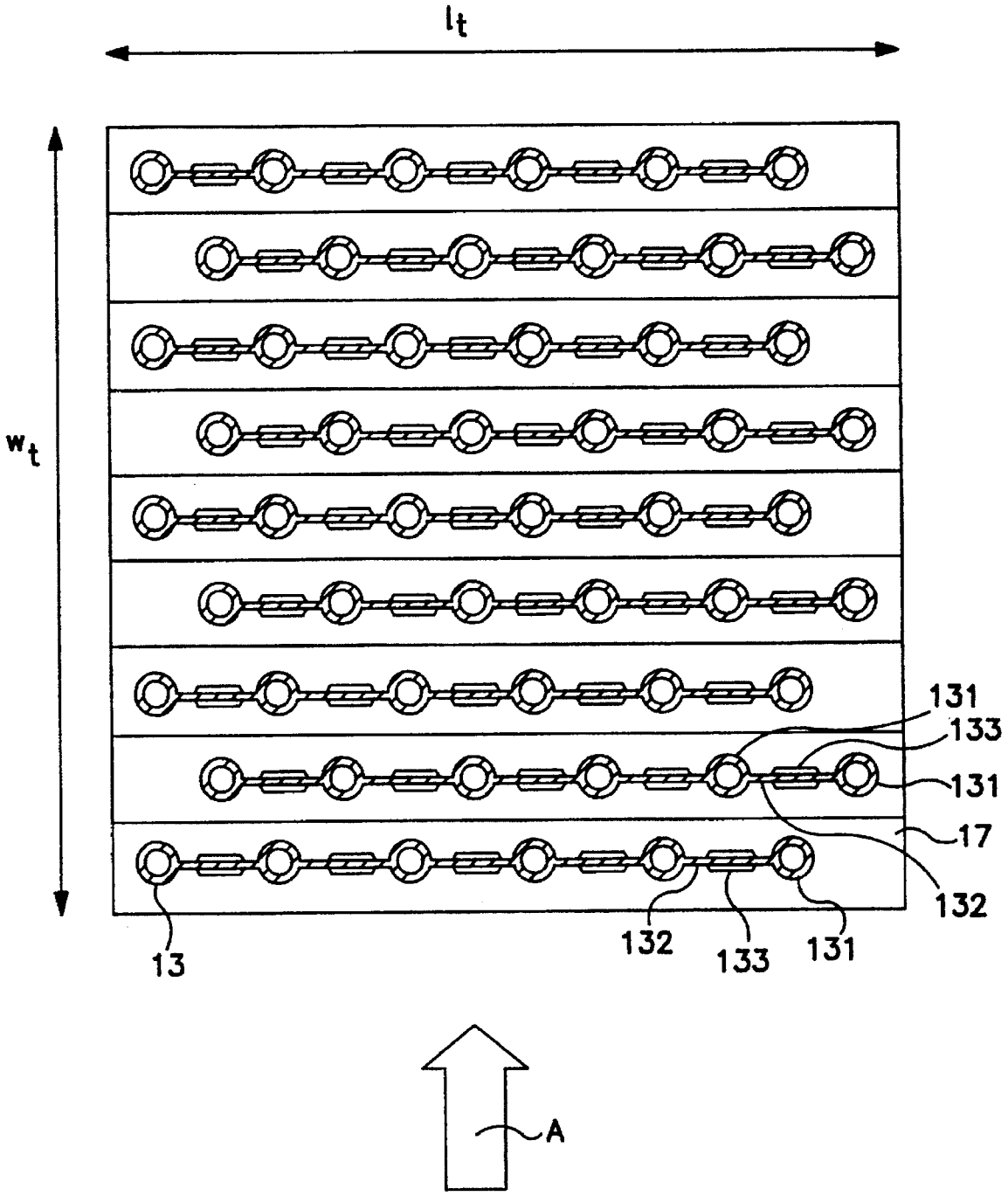
FIG. 8 is a latitudinal cross-sectional view of the evaporator shown in FIG. 7.
Figure 9:
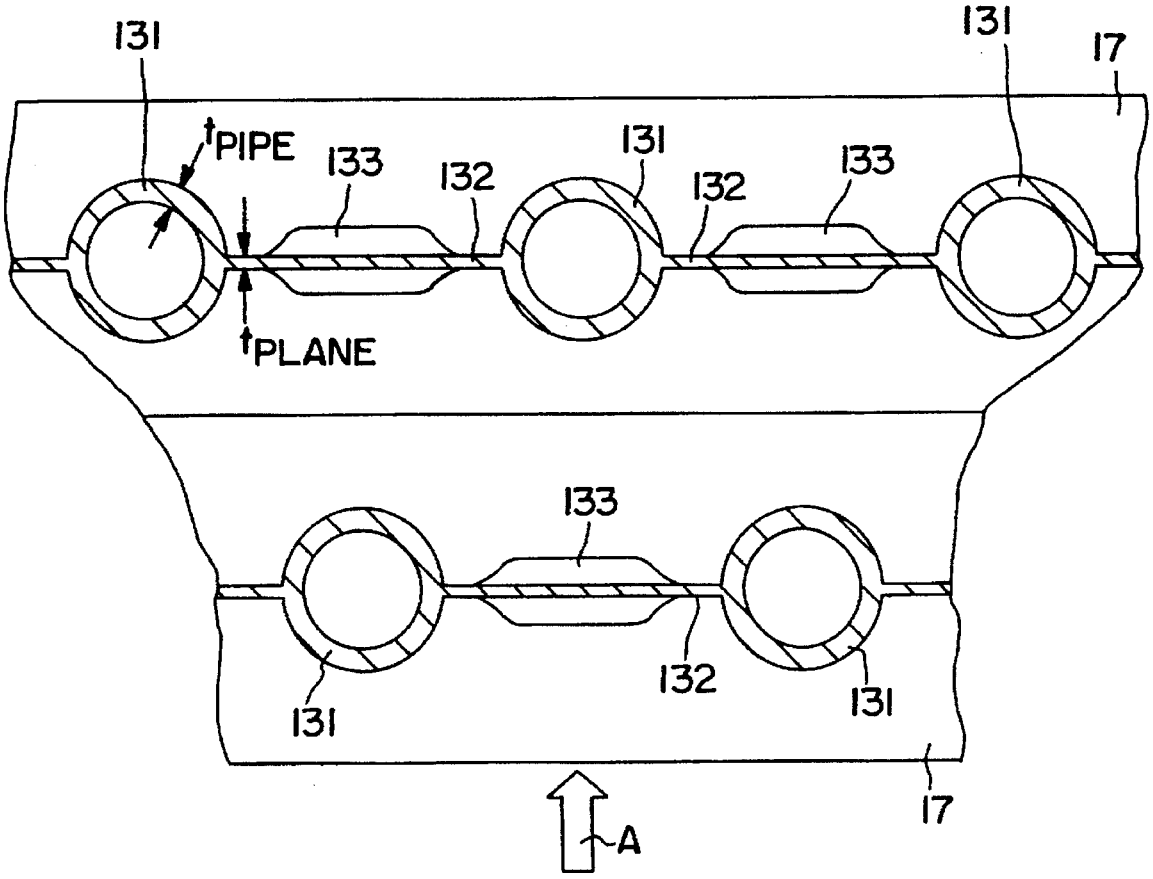
FIG. 9 is an enlarged view of FIG. 8.

Referring again to FIG. 7, heat exchange units 13 may be arranged in parallel along the width $w_t$ of tanks 11 and 12 at about equal intervals, and may extend between upper and lower tanks 11 and 12. Upper and lower tanks 11 and 12 are placed in fluid communication through pipe portions 131 of heat exchange units 13. As illustrated in FIG. 8, pipe portions 131 of adjacent heat exchange units 13 are arranged, such that they are offset by one half of the length of the interval of pipe portions 131 of heat exchange unit 13. Further, as illustrated in FIG. 9, the thickness $t_{pipe}$ of the walls of pipe portions 131 is designed to be greater than the thickness $t_{plane}$ of plane portions 132, so that pipe portions 131 are reinforced to sufficiently resist the internal pressure.

Figure 16:
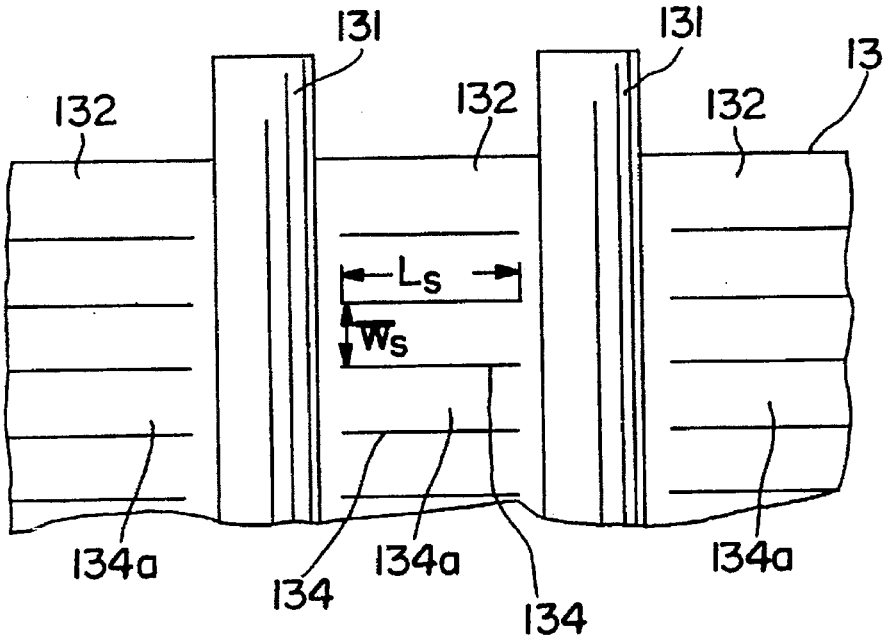
FIGS. 16–19 are views illustrating a method for manufacturing of the louvers shown in FIG. 7.
Figure 17:
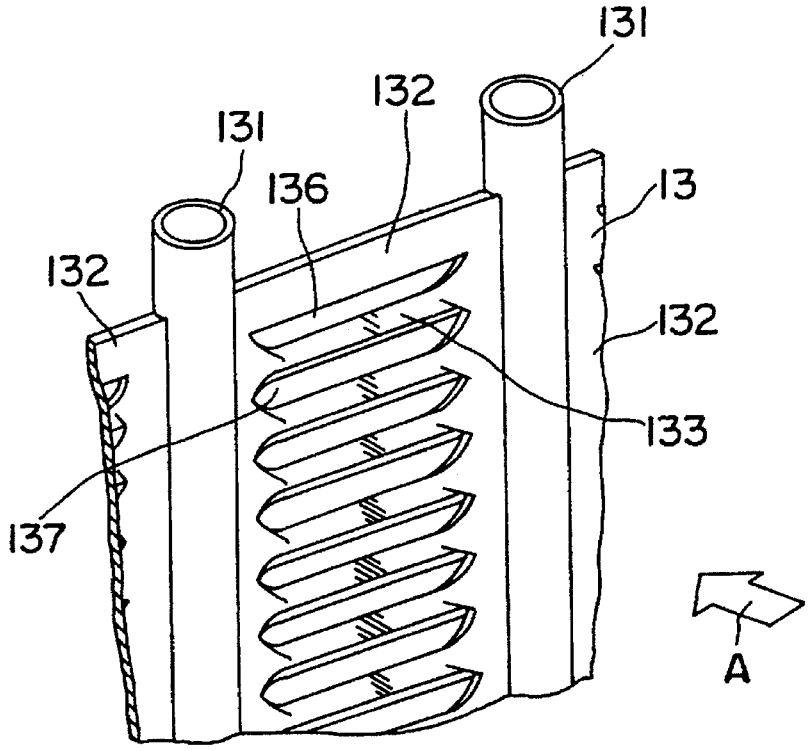
Figure 18:
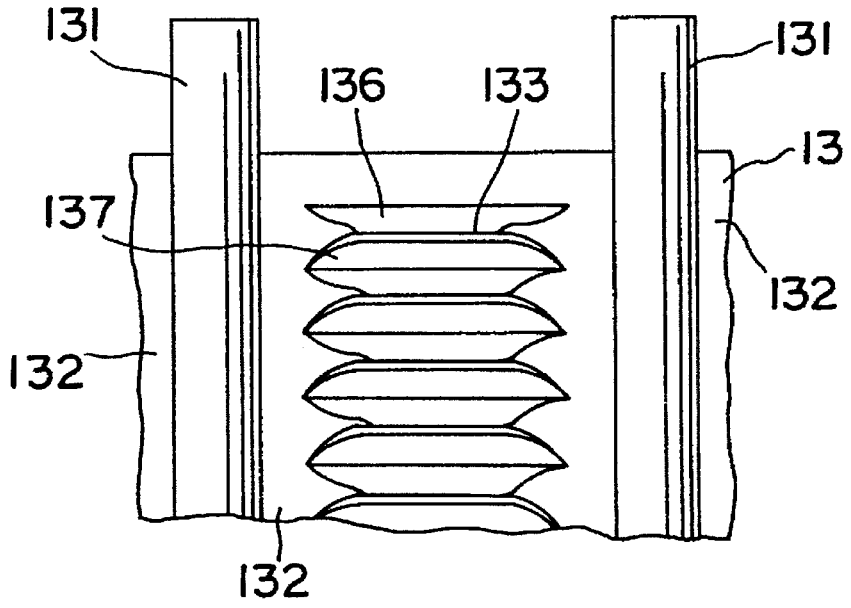
Figure 19:
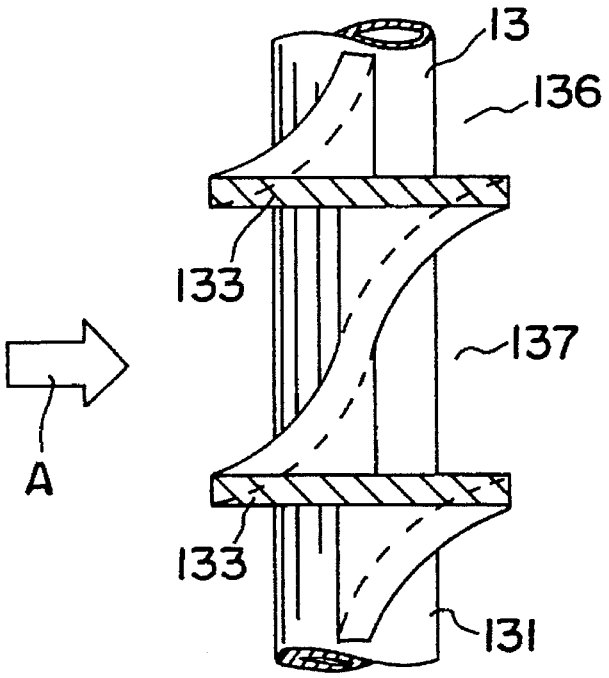

Referring to FIGS. 16–19 in view of FIG. 7, evaporator 10 is provided with a plurality of louvers 133 formed in plane portions 132 of heat exchange units 13. A method of forming louvers 133 is as follows. As illustrated in FIG. 16, a plurality of slits 134 perpendicular to the longitudinal axis of pipe portions 131 are slit in each of plane portions 132 of heat exchange unit 13 along the longitudinal axis of heat exchange unit 13, for example, by press work. Slits 134 may be spaced from one another at about equal intervals $W_s$. As shown in FIG. 16, the lengths $L_s$, of each of slits 134 are about equal. Accordingly, a plurality of identical plane belt regions **134*a* may be defined between adjacent slits 134. As slits 134 are formed in plane portion 132, each of plane belt regions 134*a* is twisted to be parallel to a plane which is perpendicular to the longitudinal axis of pipe portions 131. The above slitting and twisting processes may be performed, for example, by only one step of press work. As a result of twisting plane belt regions 134*a*, plane belt regions 134*a* are formed as louvers 133, and trapezoidal upper and lower openings 136 and 137 of louvers 133 are formed in plane portions 132, as illustrated in FIGS. 17–19. Moreover, the length $L_L$ of a front edge of louvers 133 is about equal to the length $L_s$, of slits 134**.

Referring yet again to FIG. 7, an interior space of the upper tank 11 is divided by partition plate 14 into a first chamber section 111 and a second chamber section 112. Upper tank 11 is provided with an inlet pipe 15 fixedly connected through an outside end surface of first chamber section 111 and an outlet pipe 16 fixedly connected through an outside end surface of second chamber section 112.

Figure 20:
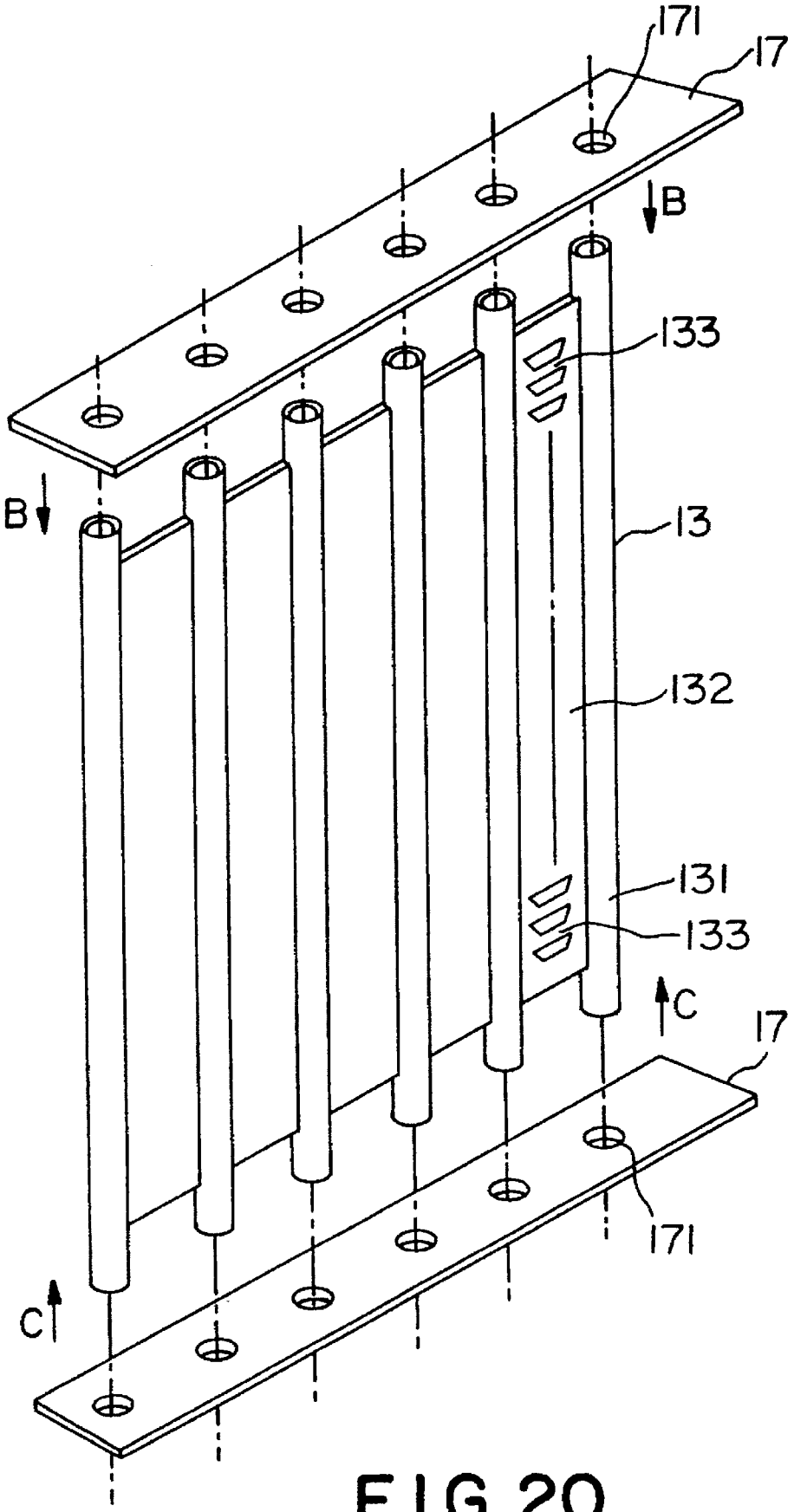
FIGS. 20–22 are views illustrating an assembling process of the evaporator shown in FIG. 7.
Figure 21:
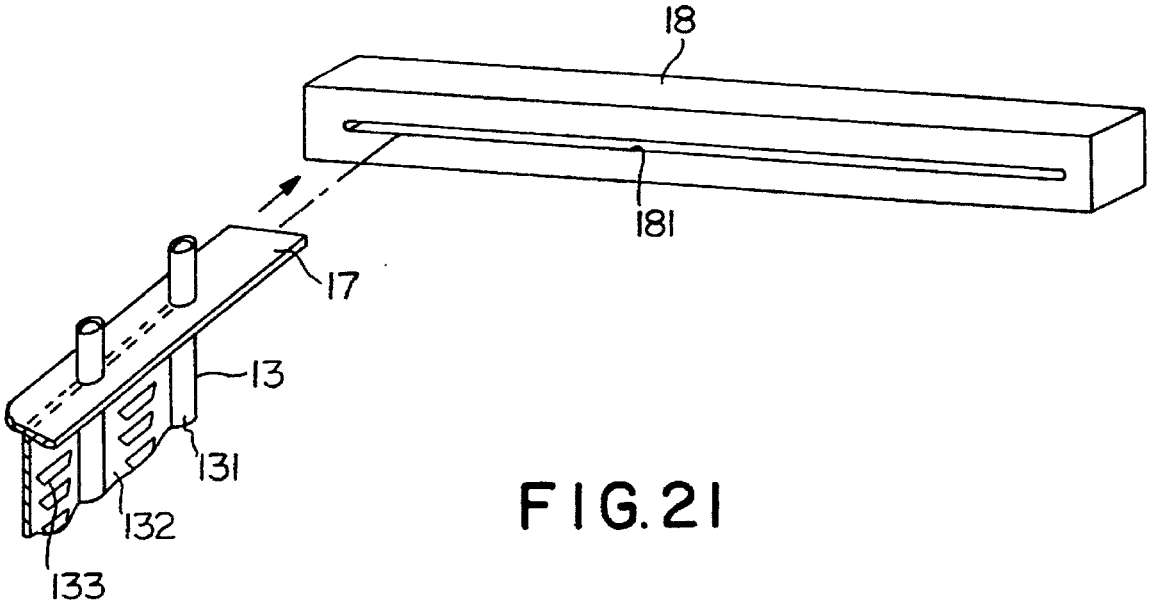
Figure 22:
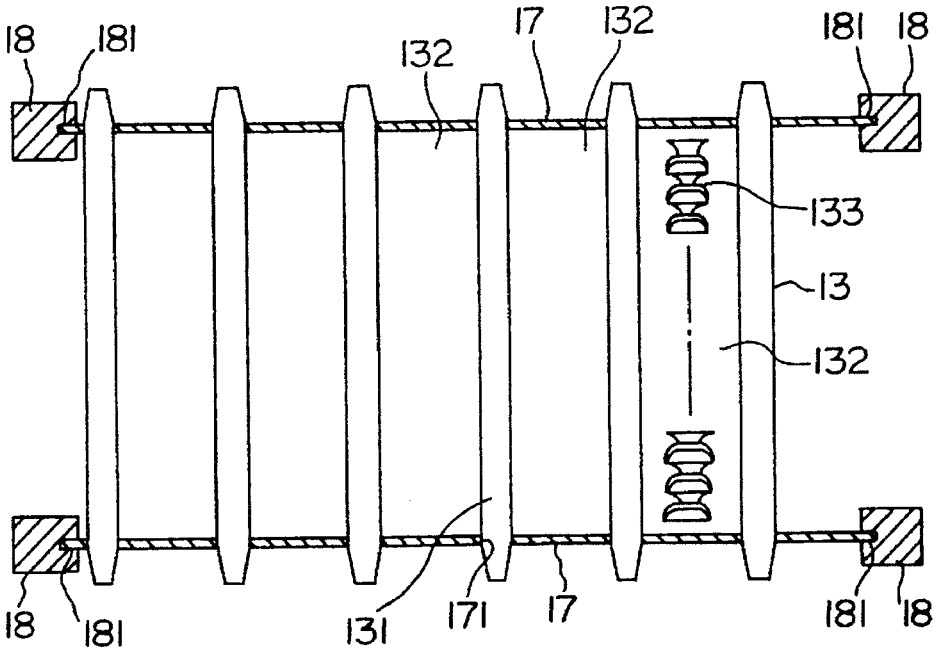

Referring to FIGS. 20–22, evaporator 10 may be assembled by the following method. First, a plurality of rectangular plates 17 are prepared. Each of plates 17 comprises a plurality of circular holes 171 formed along the longitudinal axis thereof. The number of circular holes 171 is equal to the number of pipe portions 131 of heat exchange units 13. Circular holes 171 are spaced from one another at about equal intervals, so that holes 171 correspond to the positions of pipe portions 131 of heat exchange units 13. The inner diameter of each circular hole 171 is designed to be slightly greater than an outer diameter of pipe portion 131 of heat exchange unit 13.

As indicated by arrows "B" in FIG. 20, the upper end sections of pipe portions 131 are inserted into the corresponding circular holes 171 of a plate 17, so that plate 17 is disposed on the upper end sections of plane portions 132 of heat exchange units 13. Similarly, as indicated by arrows "C" in FIG. 20, the lower end sections of pipe portions 131 are inserted into the corresponding circular holes 171 of another plate 17, so that the other plate 17 is disposed on the lower end sections of plane portions 132 of heat exchange units 13.

Next, referring to FIGS. 21 and 22, four bars 18 having a substantially square lateral cross-section are provided. Each of bars 18 includes a slot 181 formed in a side surface thereof and having an end wall. Slot 181 extends along about the entire length of bar 18 and has a width which is slightly greater than the thickness of plate 17. One end portion of each of plates 17 that are disposed on the upper end of plane portions 132 of the corresponding heat exchange units 13 may be inserted into slot 181 of first bar 18 until one end portion of plate 17 contacts the end wall of slot 181 of first bar 18. The other end portion of each of plates 17 that are disposed on the upper end of plane portions 132 of the corresponding heat exchange units 13 may be inserted into slot 181 of second bar 18 until the other end portion of plate 17 contacts the end wall of slot 181 of second bar 18. Similarly, one end portion of each of plates 17 that are disposed on the lower end of plane portions 132 of the corresponding heat exchange units 13 may be inserted into slot 181 of third bar 18 until one end portion of plate 17 contacts the end wall of slot 181 of third bar 18. Finally, the other end portion of each of plates 17 that are disposed on the lower end of plane portions 132 of corresponding heat exchange units 13 may be inserted into slot 181 of fourth bar 18 until the other end portion of plate 17 contacts the end wall of slot 181 of fourth bar 18.

Figure 15:
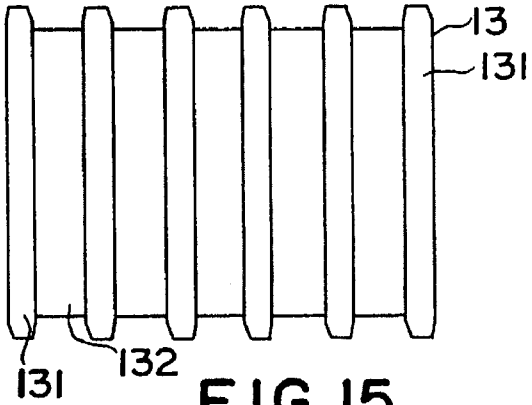
Figure 23:
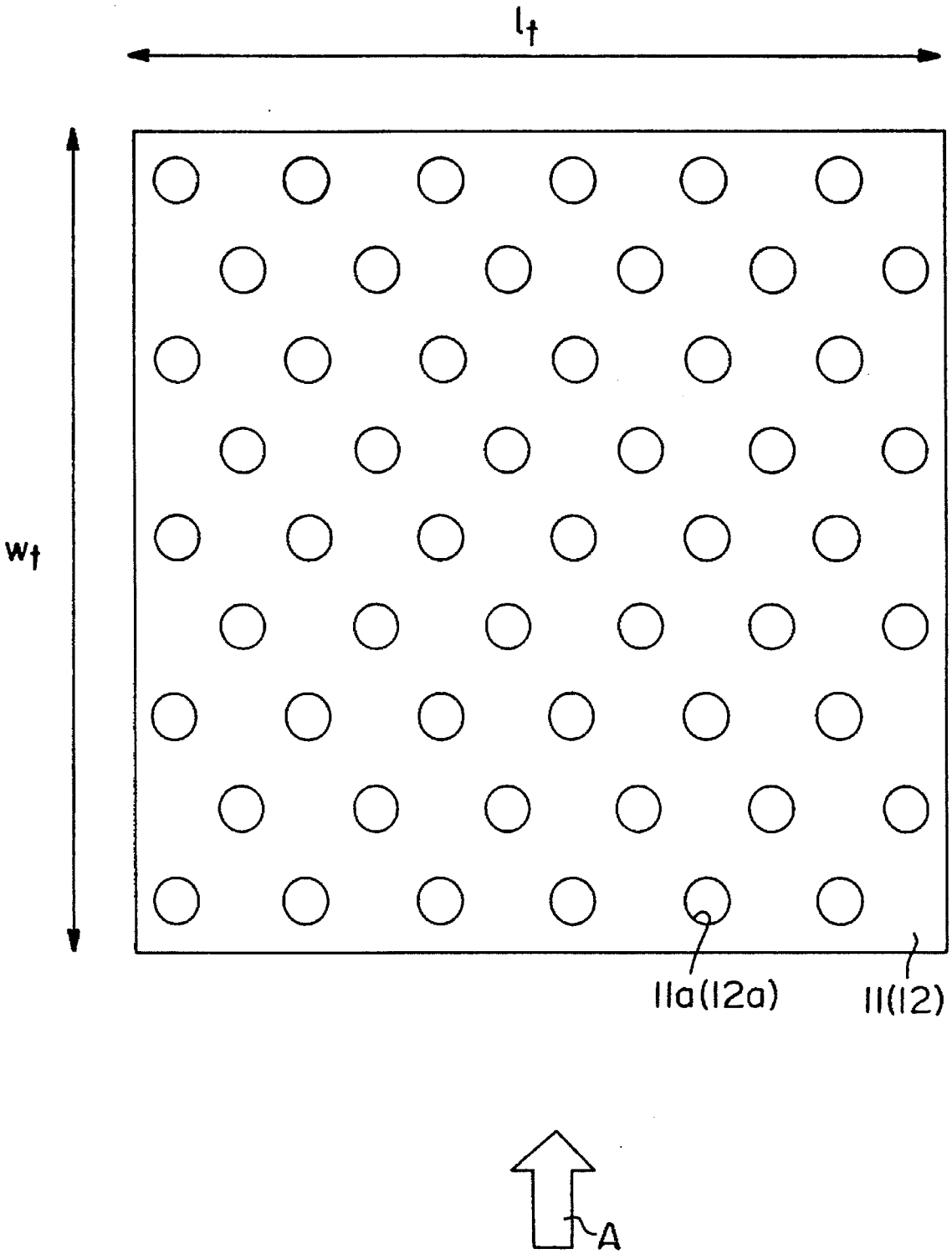
FIG. 23 is a bottom view of the upper tank shown in FIG. 7.

The upper end sections of pipe portions 131 of each of heat exchange units 13 then may be inserted into the corresponding circular holes 11*a*, which are formed at a lower end surface of upper tank 11, as illustrated in FIG. 23. In FIG. 23, circular holes 11*a* are arranged to form a plurality of rows, e.g,. nine rows, which correspond to a plurality of, e.g., nine, heat exchange units 13. In each row, holes 11*a* are spaced from one another at about equal intervals, so that holes 11*a* correspond pipe portions 131 of heat exchange units 13. Holes 11*a* of adjacent rows are offset by about one half of the length of the interval between holes 11*a* in each row. Similarly, the lower end sections of pipe portions 131 of each of heat exchange units 13 are inserted into the holes 12*a*, which are formed at the upper end surface of lower tank 12, as illustrated in FIG. 23. Moreover, the inner diameter of holes 11*a* and 12*a* is designed to be slightly greater than the outer diameter of pipe portions 131 of heat exchange units 13. In addition, because the upper and lower end sections of pipe portions 131 of heat exchange units 13 are tapered, as illustrated in FIG. 15, the upper and lower end sections of each of pipe portions 131 may be inserted into the holes 11*a* of upper tank 11 and holes 12*a* of lower tank 12, respectively, in a method of assembling evaporator 10. Four bars 18 aid in the assembly of evaporator 10. After evaporator 10 is assembled, four bars 18 may be detached and, assembled evaporator 10 may be placed in a brazing furnace for a sequential brazing process.

Although none or only some of louvers 133 are illustrated in FIGS. 7, 10–12, 15, 20, and 22, louvers 133 are formed in each of plane portions 132 of each heat exchange units 13 and are arranged from the upper to lower ends of each plane portion 132. Moreover, as illustrated in FIG. 7, when evaporator 10 is installed, heat exchange units 13 are oriented, so that plane portions 132 are aligned perpendicular to the flow direction, indicated by arrow "A," of air which passes through evaporator 10. Consequently, pipe portions 131 also are perpendicular to the flow direction "A" of air passing through evaporator 10. The flow direction of the air passing through evaporator 10 also is indicated by arrow "A" in FIGS. 8–9, 17, 19, and 23.

During operation of the automotive air conditioning system, the refrigerant fluid is conducted into first chamber section 111 of upper tank 11 from an element of the automotive air conditioning system, such as a condenser (not shown), via inlet pipe 15. The refrigerant fluid conducted into first chamber section 111 of upper tank 11 flows downwardly through a first group of pipe portions 131 of heat exchange units 13. When the refrigerant fluid flows downwardly through the first group of pipe portions 131 of heat exchange units 13, the refrigerant exchanges heat with the air flowing across the exterior surfaces of heat exchange units 13, so that heat from the air is absorbed through plane portions 132.

The refrigerant fluid flowing downwardly through the first group of pipe portions 131 of heat exchange units 13 flows into a first portion of an interior space of lower tank 12, which corresponds to first chamber section 111. Thereafter, the refrigerant fluid in the first portion of the interior space of lower tank 12 flows to a second portion of the interior space of lower tank 12, which corresponds to second chamber section 112, and then flows upwardly through a second group of pipe portions 131 of heat exchange units 13. When the refrigerant fluid flows upwardly through the second group of pipe portions 131 of heat exchange units 13, the refrigerant further exchanges heat with the air flowing across the exterior surfaces of heat exchange units 13, so that the heat from the air is further absorbed through plane portions 132.

The refrigerant fluid flowing upwardly through the second group of pipe portions 131 of heat exchange units 13 flows into second chamber section 112 of upper tank 11. The refrigerant fluid in second chamber section 112 of upper tank 11 then is conducted to other elements of the automotive air conditioning system, such as a compressor (not shown), via outlet pipe 16.

In a first embodiment of the present invention, the air passing through evaporator 10 is cut by the front edge of louvers 133 with an effective length l, determined by equation (1):

$$l=L_L \cdot \sin\theta \quad (1)$$

Because heat exchange units 13 are oriented, so that plane portions 132 are aligned perpendicular to the flow direction, indicated by arrow "A," of air which passes through evaporator 10, angle theta θ equals +90°. Therefore, the effective length l of the front edge of louvers 133 equals $L_L$, which is the maximum value thereof.

As described above, with regard to louvers 133, the following relationships are observed:

a. Angle Theta θ∝Effective Length l;

b. Effective Length l∝Front Edge Effect;

c. Front Edge Effect∝Heat Transfer Rate; and d. Heat Transfer Rate∝Performance of Evaporator.

Accordingly, the performance of evaporator 10 increases.

On the other hand, because angle phi ϕ, which is created between louvers 133 and a plane perpendicular to the longitudinal axes of pipe portions 131, is zero degrees, the length $L_L$of louvers 133 is minimized under the condition where the interval between the adjacent pipe portions 131 of heat exchange unit 13 is fixed. Further, the length $L_L$ of louvers 133 is also about equal to the length $L_s$, of slits 134. Thus, as described above with regard to louvers 133, the following additional relationships are observed:

a. Angle Phi ϕ∝Length $L_L$;

b. 1/(Length $L_L$)∝Fin Efficiency; and c. Fin Efficiency∝Performance of Evaporator.

Accordingly, the performance of evaporator 10 also increases.

As described above, according to the first embodiment of the present invention, both the heat transfer rate, i.e., the heat transfer coefficient, and the fin efficiency of louvers 133 increase, so that the performance aporator 10 increases. Further, according to this first embodiment, pipe portions 131 of adjacent heat exchange units 13 are arranged to be offset by one half of the length of the interval between adjacent pipe portions 131 of heat exchange units 13, as illustrated in FIG. 8. Therefore, the air passing through evaporator 10 uniformly flows across the exterior surfaces of heat exchange units 13. As a result, the exchange of heat between the refrigerant and the air passing through evaporator 10 is effectively accomplished. In addition, according to the first embodiment of the present invention, plane portions 132 of heat exchange units 13 function substantially as fin members. Therefore, plane portions 132 may be thinned to the limits of the mechanical strength thereof. Thus, a lightweight evaporator may be obtained in addition to the other advantages described above.

Figure 24:
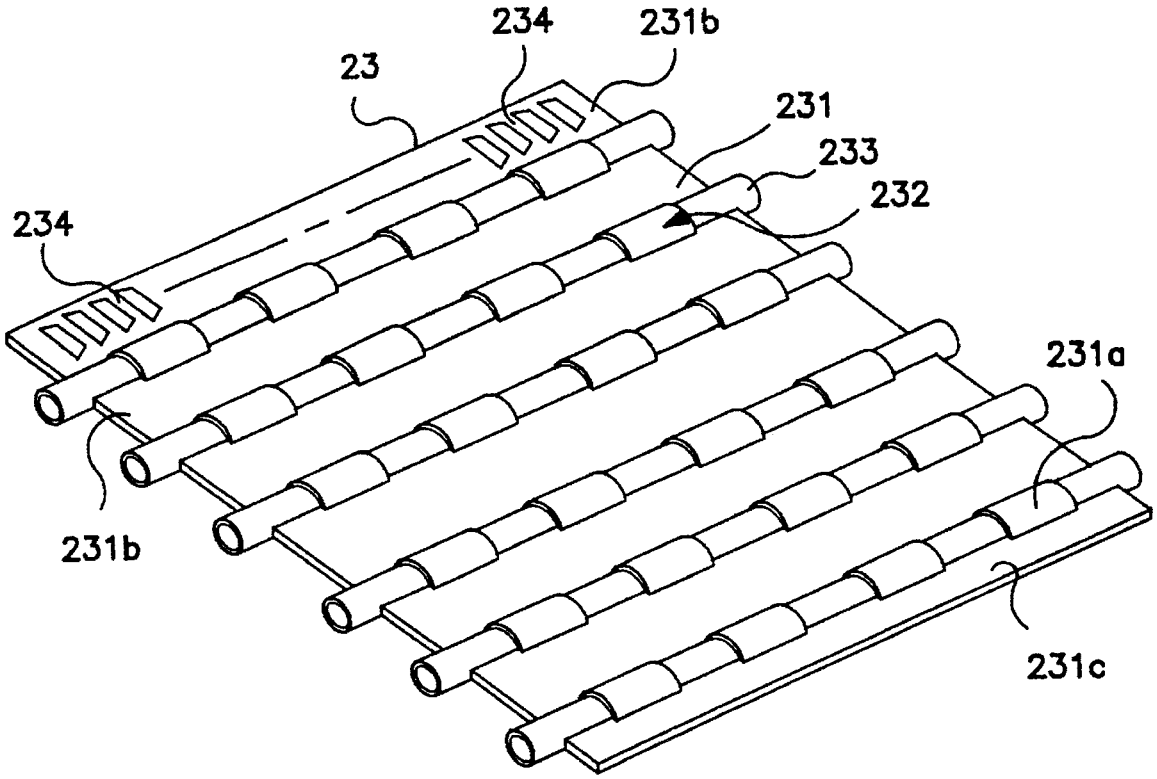
FIG. 24 is a perspective view of a heat exchange unit of an evaporator in accordance with a second embodiment of the present invention.

FIG. 24 illustrates one of a plurality of substantially identical heat exchange units 23 of a heat exchanger in accordance with a second embodiment of the present invention. Referring to FIG. 24, heat exchange unit 23 includes a single thin plate member 231 of an aluminum alloy. A plurality of first arch portions 231*a* and a plurality of second arch portions (not shown) are bulged from the plane of plate member 231 alternately in opposite directions. First arch portions 231*a* and second arch portions (not shown) are aligned in a plurality of rows which extend parallel to the longitudinal axis of plate member 231. Moreover, first arch portions 231*a* and second arch portions (not shown) alternately follow one another in each of the rows, so that a plurality of substantially cylindrical passages 232 are formed in the plane of thin plate member 231. Plane region 231*b* is defined in thin plate member 231 between the adjacent substantially cylindrical passages 232. Heat exchange unit 23 further includes a plurality of pipe members 233 made of an aluminum alloy penetrating through the substantial cylindrical passages 232. The length of pipe members 233 is designed to be greater than the height of plate member 231. Therefore, when pipe members 233 are disposed in the corresponding substantially cylindrical passages 232, the ends of pipe members 233 project beyond the edges of plate member 231.

A plurality of louvers 234, which are identical to louvers 133 as illustrated in FIG. 17, are formed in plane regions 231*b* of plate member 231. However, no louver 234 is formed at least one outer plane region 231*c* because that the width of at least one outer plane region 231*c* of plate member 231 is designed to be narrower than that of the other plane regions 231*b*. The second embodiment achieves efficiencies substantially similar to those of the first embodiment.

Although several preferred embodiments of the present invention have been described in detail herein, it will be appreciated by those skilled in the art that various modifications may be made without materially departing from the novel and advantageous teachings of the invention. Accordingly, the embodiments disclosed herein are by way of example. It is to be understood that the scope of the invention is not to be limited thereby, but is to be determined by the claims which follow.

I claim:

1. A heat exchanger comprising:

a first tank and a second tank space vertically from said first tank, and at least one connecting member which extends between said first tank and said second tank;

said at least one connecting member comprising a plurality of pipe portions, each having a longitudinal axis, which place said first tank and said second tank in fluid communication, and a plurality of plane portions, one of which is fixedly disposed between each pair of adjacent pipe portions, wherein said plane portions are co-planar with said longitudinal axes of said pipe portions;

a plurality of openings formed in said plane portions and extending along a longitudinal axis of said at least one connecting member; and a plurality of louvers formed at said openings, respectively, so that said louvers are parallel to a plane, which is perpendicular to the longitudinal axes of said pipe portions;

wherein said at least one connecting member is oriented, so that said plane portions are perpendicular to a flow direction of air which passes through said heat exchanger.

2. The heat exchanger of claim 1 wherein said upper and lower tanks are rectangular parallelepiped in shape.

3. The heat exchanger of claim 1 wherein said at least one connecting member is made of an aluminum alloy.

4. The heat exchanger of claim 1 wherein each of said pipe portions has a circular cross-section.

5. A method of manufacturing a heat exchanger; said heat exchanger including, a first tank and a second tank spaced vertically from said first tank, and at least one connecting member which extends between said first tank and said second tank;

said at least one connecting member comprising a plurality of pipe portions, each having a longitudinal axis, which place said first tank and said second tank in fluid communication, and a plurality of plane portions, one of which is fixedly disposed between each pair of adjacent pipe portions, wherein said plane portions are co-planar with said longitudinal axes of said pipe portions;

comprising the steps of:

forming a plurality of slits in said plane portions along the longitudinal axis of said at least one connecting member, so that said slits are perpendicular to the longitudinal axes of said pipe portions, thereby defining a plurality of plane belt regions between and adjacent slits; and twisting each of said plane belt regions, so that said plane belt regions are parallel with a plane perpendicular to the longitudinal axes of said pipe portions.

6. A heat exchanger comprising:

a first tank and a second tank spaced vertically from said first tank, and at least one connecting member which extends between said first tank and said second tank;

said at least one connecting member comprising a plurality of pipe portions, each having a longitudinal axis, which place said first tank and said second tank in fluid communication, and a plurality of plane portions, one of which is fixedly disposed between each pair of adjacent pipe portions, wherein said plane portions are co-planar with said longitudinal axes of said pipe portions, and a plurality of first arch portions and a plurality of second arch portions, said first and said second arch portions bulged in opposite directions and arranged in a plurality of rows;

a plurality of openings formed in said plane portions and extending along a longitudinal axis of said at least one connecting member; and a plurality of louvers formed at said openings, respectively, so that said louvers are parallel to a plane, which is perpendicular to the longitudinal axes of said pipe portions;

wherein said at least one connecting member is oriented, so that said plane portions are perpendicular to a flow direction of air which passes through said heat exchanger.

7. The heat exchanger of claim 6 wherein said upper and lower tanks are rectangular parallelepiped in shape.

8. The heat exchanger of claim 6 wherein said at least one connecting member includes a single plate, from which said planes portions and said first and said second arch portions are formed.

9. The heat exchanger of claim 6 wherein said at least one connecting member is made of an aluminum alloy.

10. The heat exchanger of claim 6 wherein each of said pipe portions has a circular cross-section.

11. A method of manufacturing a heat exchanger; said heat exchanger including, a first tank and a second tank spaced vertically from said first tank, and at least one connecting member which extends between said first tank and said second tank;

said at least one connecting member comprising a plurality of pipe portions, each having a longitudinal axis, which place said first tank and said second tank in fluid communication, and a plurality of plane portions, one of which is fixedly disposed between each pair of adjacent pipe portions, wherein said plane portions are co-planar with said longitudinal axes of said pipe portions, and a plurality of first arch portions and a plurality of second arch portions, said first and said second arch portions bulged in opposite directions and arranged in a plurality of rows;

comprising the steps of:

forming a plurality in said plane portions along the longitudinal axis of said at least one connecting member, so that said slits are perpendicular to the longitudinal axes of said pipe portions, thereby defining a plurality of plane belt regions between said adjacent slits; and twisting each of said plane belt regions, so that said plane belt regions are parallel with a plane perpendicular to the longitudinal axes of said pipe portions.

12. The method of claim 11 wherein said at least one connecting member includes a single plate, from which said planes portions and said first and said second arch portions are formed.

* * * * *